US008319630B1

(12) United States Patent
Salwan

(10) Patent No.: US 8,319,630 B1
(45) Date of Patent: Nov. 27, 2012

(54) AIR-CUSHIONED BAG WITH ELECTRO-MECHANICAL DEVICES FOR SAFELY AND SECURELY TRANSPORTING OBJECTS

(76) Inventor: Angadbir Singh Salwan, Potomac, MD (US)

( * ) Notice: Subject to any disclaimer, the term of this patent is extended or adjusted under 35 U.S.C. 154(b) by 0 days.

(21) Appl. No.: 13/411,391

(22) Filed: Mar. 2, 2012

(51) Int. Cl.
*G08B 1/00* (2006.01)

(52) U.S. Cl. ..... 340/539.1; 340/572.1; 340/572.8; 340/8.1; 206/459.5; 206/521; 206/522; 206/523; 383/109; 383/61.3; 53/472

(58) Field of Classification Search ..... 340/572.1, 340/572.8, 8.1; 206/459.5, 521, 522, 523; 383/109, 61.3; 53/472
See application file for complete search history.

(56) References Cited

U.S. PATENT DOCUMENTS

| | | | | |
|---|---|---|---|---|
| 5,141,107 | A | 8/1992 | Wiedermann et al. | |
| 5,624,035 | A | 4/1997 | Kim | |
| 5,819,942 | A | 10/1998 | Sadow | |
| 6,375,009 | B1 | 4/2002 | Lee | |
| 7,106,202 | B2 * | 9/2006 | Dickinson | 340/572.8 |
| 7,133,843 | B2 | 11/2006 | Hansmann et al. | |
| 7,826,920 | B2 | 11/2010 | Stevens et al. | |
| 8,089,753 | B2 | 1/2012 | Dotson | |
| 2003/0062405 | A1 * | 4/2003 | Luu et al. | 229/117.33 |
| 2005/0029149 | A1 | 2/2005 | Leung et al. | |
| 2006/0027472 | A1 | 2/2006 | Gokcen et al. | |
| 2006/0071786 | A1 | 4/2006 | Fano | |
| 2006/0207849 | A1 | 9/2006 | Sadow | |
| 2007/0083921 | A1 | 4/2007 | Parris et al. | |
| 2009/0040101 | A1 * | 2/2009 | Ani et al. | 342/357.07 |
| 2010/0303387 | A1 * | 12/2010 | Dahlquist | 383/3 |

FOREIGN PATENT DOCUMENTS

| | | |
|---|---|---|
| CN | 201839963 | 5/2011 |

* cited by examiner

*Primary Examiner* — Daryl Pope

(57) ABSTRACT

An air-cushioned bag for safely and securely transporting objects (9) is comprised of a housing (1) to store objects (9), an electric pump (3), a pressure sensor (6) and an electrical power source (5). The housing walls are filled with air to different pre-determined pressure values depending on the types of objects (9) to provide safe transportation. The bag also has an electronic controller (12), a unique electronic ID, an electronic lock (10), a remote control (14), an explosive sensor (19) and a GPS device (16). The unique electronic ID and the explosive sensor (19) facilitate secure transportation of the bag. The bag can be remotely tracked during transportation with the remote control (14) or a computer equipped with a GPS tracking system.

20 Claims, 3 Drawing Sheets

Basic Transportation Bag

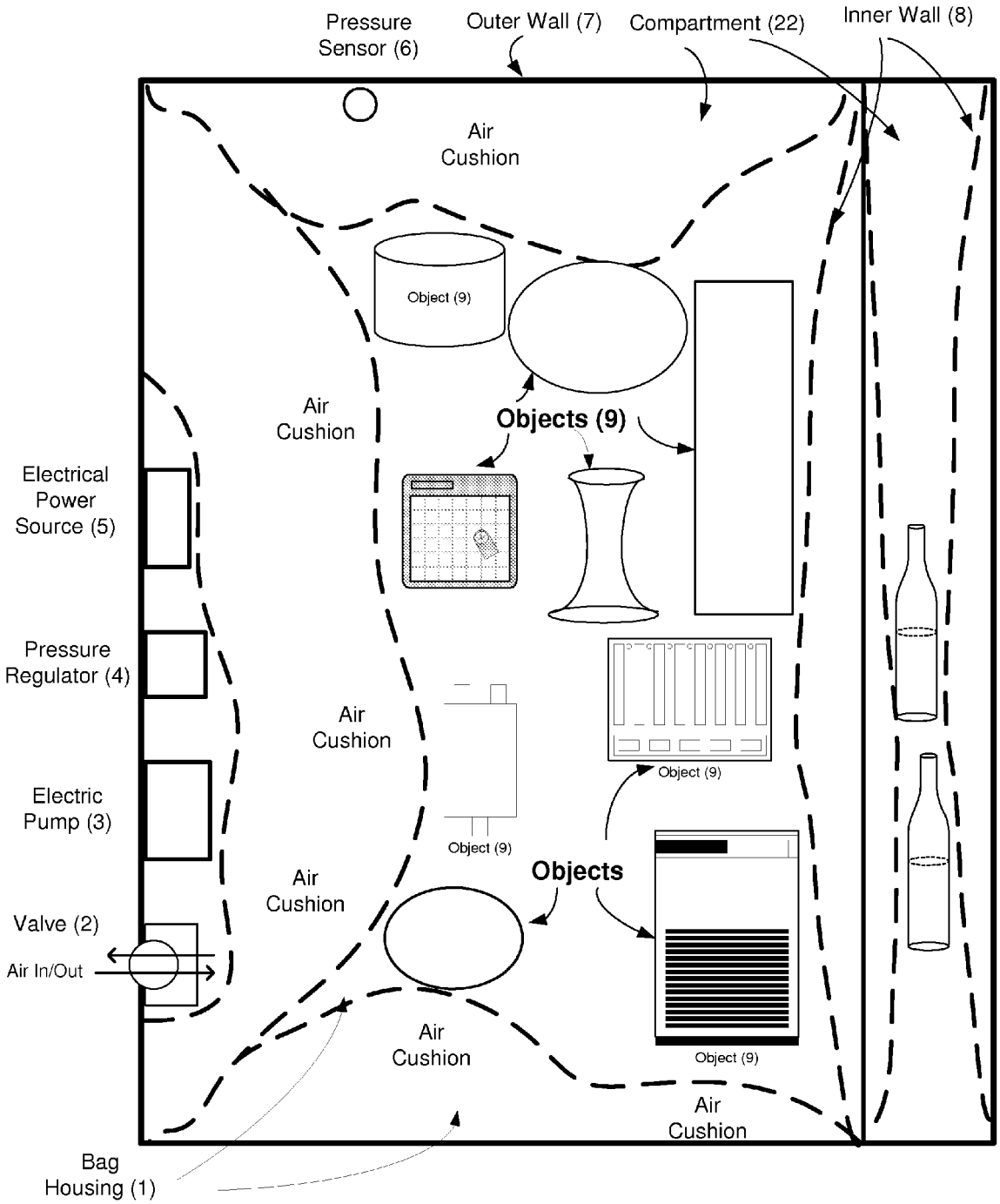
Figure 1. Basic Transportation Bag

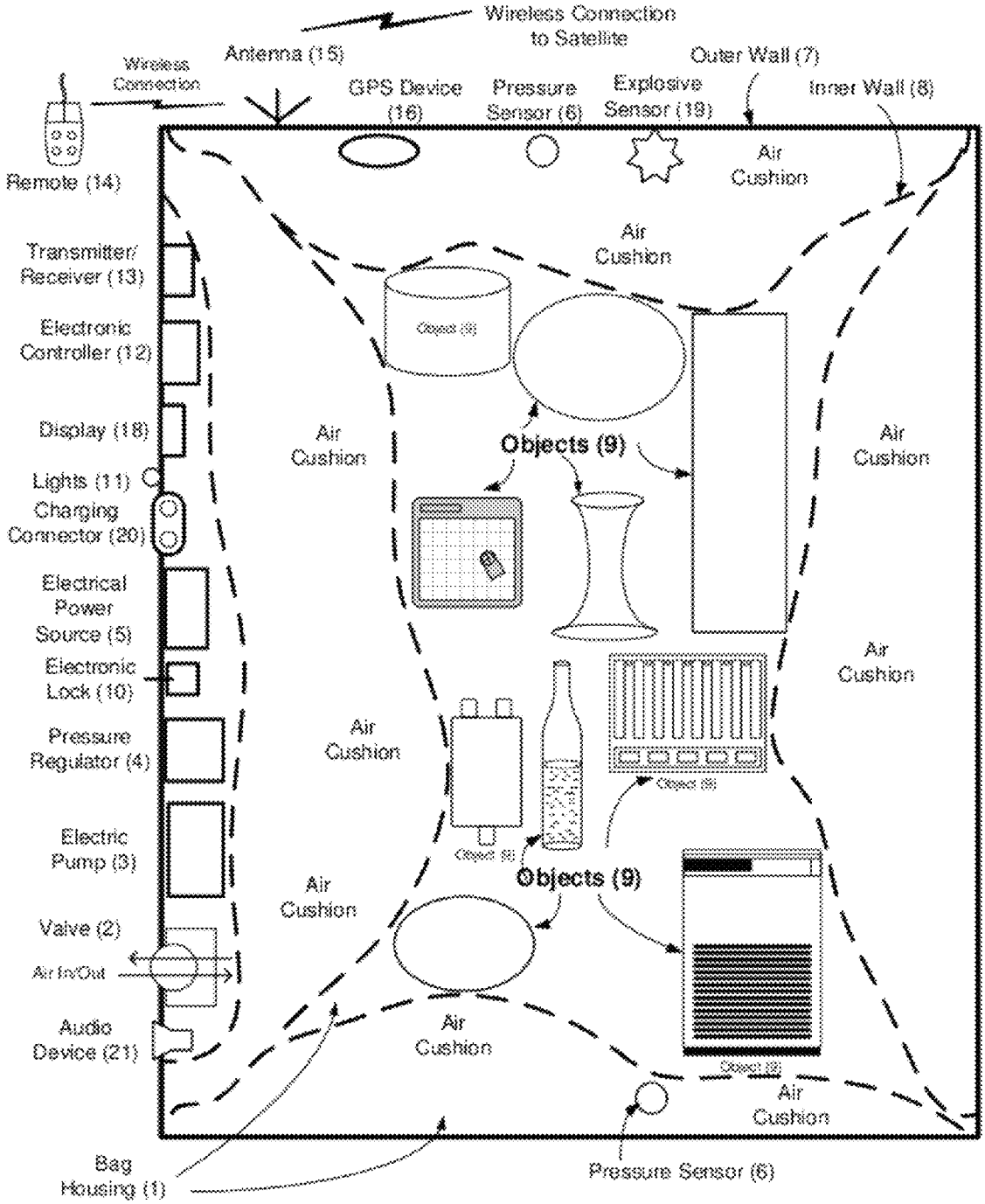
Figure 2. Transportation Bag with Remote, Explosive Sensor and GPS Device

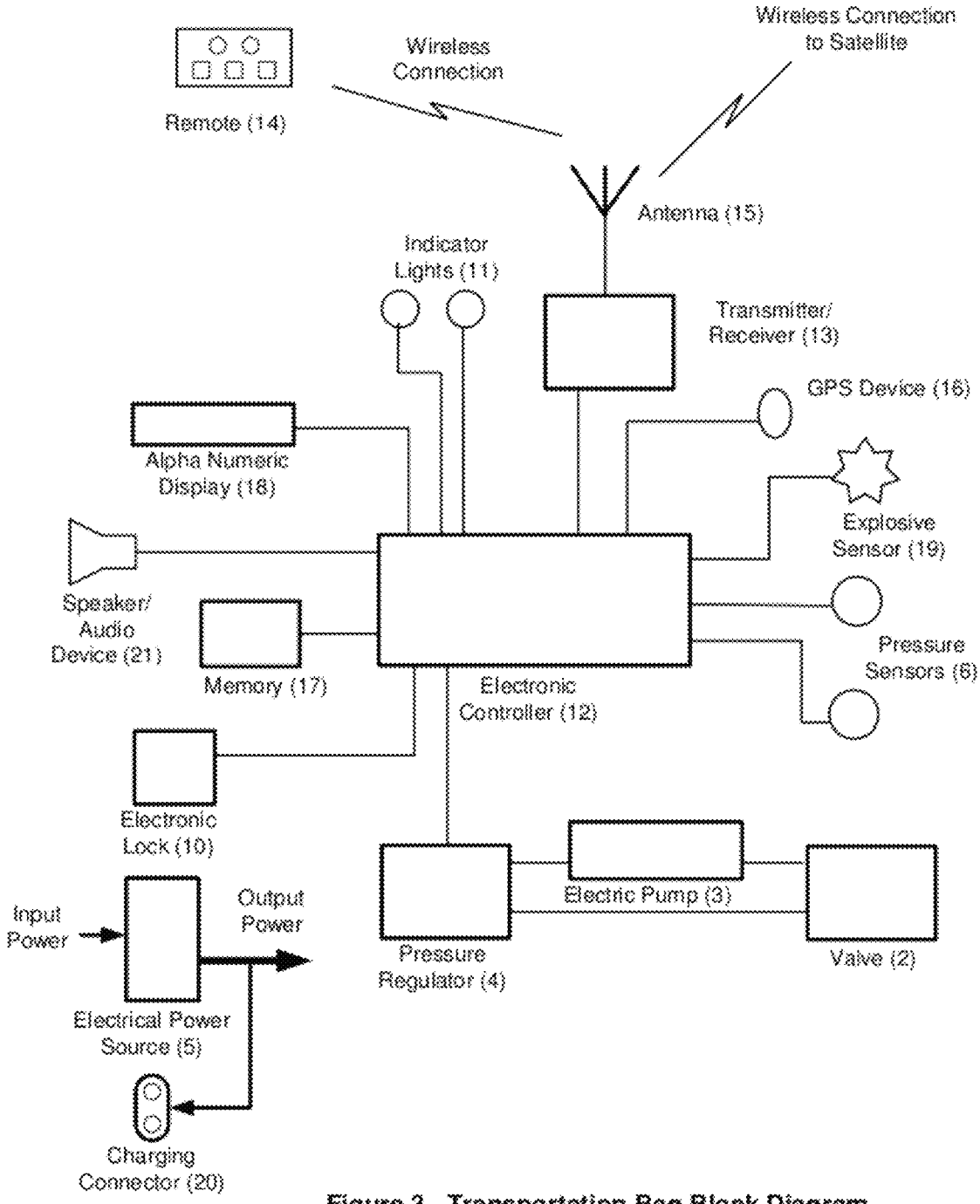
Figure 3. Transportation Bag Block Diagram

AIR-CUSHIONED BAG WITH ELECTRO-MECHANICAL DEVICES FOR SAFELY AND SECURELY TRANSPORTING OBJECTS

CROSS REFERENCE TO RELATED APPLICATION

Not applicable.

BACKGROUND OF THE INVENTION

Field of Invention

The present invention relates to the field of luggage and carrying bags for safely and securely transporting objects. More specifically, the present invention relates to air-cushioned bags with built-in electro-mechanical devices to provide safety, security and tracking during transportation.

RELATED U.S. PATENTS

| Pat. No. | Issue Date | Patentee |
|---|---|---|
| 6,375,009 | 2002 Apr. 23 | Lee, Chung Kyun |
| 5,624,035 | 1997 Apr. 29 | Kim, Young S. |
| 5,819,942 | 1998 Oct. 23 | Sadow; Bernard David |
| 8,089,753 | 2012 Jan. 03 | Dotson; Leslie Chan |
| 5,141,107 | 1992 Aug. 25 | Wiedermann, et al. |
| 7,106,202 | 2006 Sep. 12 | Dickinson, Kent H. |
| 7,133,843 | 2006 Nov. 07 | Hansmann, et al. |
| 7,826,920 | 2010 Nov. 02 | Stevens, et al. |

RELATED U.S. PATENT APPLICATION PUBLICATIONS

| Publication Number | Publication Date | Applicant |
|---|---|---|
| 20060071786 | 2006 Apr. 06 | Fano, Andrew E. |
| 20060027472 | 2006 Feb. 09 | Gokcen; Selma; et al. |
| 20060207849 | 2006 Sep. 21 | Sadow, Bernard D. |
| 20050029149 | 2005 Feb. 10 | Leung; Grant; et al. |
| 20070083921 | 2007 Apr. 12 | Parris; Earl H.; et al. |

RELATED FOREIGN PATENT DOCUMENTS

| Foreign Doc. No. | Country Code | Publication Date | Applicant/Patentee |
|---|---|---|---|
| 201839963 | CN | 2011 May 25 | Shanghai Kerun Bag Product Co. LTD |

The luggage and shipping industry has been struggling for a long time to build carrying bags, travel bags and shipping containers with effective cushioning for safely transporting objects, especially fragile items like electronic gadgets and glass objects. The luggage manufacturers build bags with nominal cushioning and certain standard dimensions allowed by the airlines, or to fit certain items like laptop computers. When a passenger packs his/her belongings in a suitcase, or a carrying bag, he/she always has to use some kind of packaging like bubble-wrap, paper or clothes to surround fragile items. Many times, a passenger does not have enough packaging material available to fill the empty space in the bag. If the bag is not full, the items are displaced during transportation especially on the luggage belt at the airports, and many times, fragile items are damaged and clothes get wrinkled no matter how well they were originally packed in the bag.

The prior art has disclosed bags with fixed pre-inflated or manually inflatable air cushions. But no prior art has suggested a solution for the real world problem faced by the traveler, that is, how to inflate the bag walls to fill the empty space inside the bag after packing and closing the bag. Since the bag is not transparent, the traveler is unable to see the condition of his belongings as the bag walls are manually filled with air.

Another problem faced by the travelers is to identify their bags on the luggage belt at the airport since the sizes and colors of most bags are similar. The bags manufactured till date, and the prior art does not suggest any easy means of identification from a short distance, especially when the belt area is crowded.

Another problem faced by the world is terrorism when travel bags containing explosives are used by the terrorists. The bags manufactured till date, and the prior art does not suggest having a unique ID (identifier) and any mechanism to track the bag after it leaves manufacturer's factory and moves around the world by different travelers. The prior art also does not suggest bags and containers with explosive sensors installed inside.

BRIEF SUMMARY OF THE INVENTION

An air-cushioned transportation bag disclosed herein offers a solution for the above mentioned problems. The first embodiment of the bag (FIG. 1) comprises a housing (1) with two compartments (22) to store the objects (9). The housing walls (7,8) are filled with air to provide an optimum cushioning inside the compartment irrespective of the empty space and volume of the objects for safe transportation. The bag has an electric pump (3) to inflate/deflate the flexible inner walls (8), an air inlet/outlet valve (2), a pressure regulator (4), an electrical power source (5) and pressure sensors (6).

In addition to the elements of the first embodiment, the second embodiment (FIG. 2) of the bag also includes an electronic controller (12), an electronic lock (10), a transmitter/receiver (13), an antenna (15) and a remote control (14). The traveler can lock/unlock the bag, inflate/deflate the bag and track it during transportation using the remote control.

In addition to the elements of the second embodiment, the third embodiment (FIG. 2) of the bag also includes a unique electronic ID and a GPS device (16) which enables remote tracking of the bag and provides security in case the bag is misplaced, lost or stolen.

In addition to the elements of the third embodiment, the forth embodiment (FIG. 2) of the bag also includes an explosive sensor (19) which enables detection of explosives inside the bag and provides security in case terrorists hide explosives in the bag.

BRIEF DESCRIPTION OF THE DRAWINGS

Figures

FIG. 1 illustrates the Basic Transportation bag.

FIG. 2 illustrates the Transportation Bag with Remote Control, GPS Device and Explosive Sensor.

FIG. 3 illustrates the Transportation Bag Block Diagram.

REFERENCE NUMERALS

| | | |
|---|---|---|
| (1) Bag Housing | (2) Valve | (3) Electric Pump |
| (4) Pressure Regulator | (5) Electrical Power Source | (6) Pressure Sensor |
| (7) Outer Wall | (8) Inner Wall | (9) Objects |
| (10) Electronic Lock | (11) Lights | (12) Electronic Controller |
| (13) Transmitter/receiver | (14) Remote Control | (15) Antenna |
| (16) GPS Device | (17) Memory | (18) Alpha Numeric Display |
| (19) Explosive Sensor | (20) Charging Connector | (21) Speaker/Audio Device |

DETAILED DESCRIPTION OF THE INVENTION

Definitions

The following definitions apply to the transportation bag system within the scope of the present invention.

Fixed Outer Wall

A fixed outer wall (7) of a transportation bag/container is made of a rigid or a semi-rigid material. When the space between the outer wall (7) and the inner wall (8) of the bag is filled with air, the outer wall remains fixed and does not change its shape. Some examples of rigid fixed outer walls are hard-shelled luggage bags and shipping containers. Examples of semi-rigid fixed outer walls are luggage bags, computer cases and hand bags made of soft cloth or leather.

Expandable Inner Wall

An expandable inner wall (8) of a transportation bag/container is made of flexible material. When the space between the outer wall (7) and the inner wall (8) is filled with air, the inner wall expands to fill the empty space and surround the objects (9) inside the bag compartment.

Electric Pump

An electric pump (3) is an electro-mechanical device for inflating/deflating the walls (8) of the bag. Some examples of the electric pump (3) are: a compressor; an electric fan to create air pressure; a mechanical piston actuated by an electric motor.

Pressure Regulator

A pressure regulator (4) is a device to control the air pressure inside the bag walls (7,8). The pressure regulator (4) may be a mechanical device, an electrical/electronic device or an electro-mechanical device. Some examples of a regulator performing the regulating function are: by opening/closing the valve (2); turning the power switch On/Off for the electric pump (3); regulating the voltage applied to the electric pump (3).

Electrical Power Source

An electrical power source (5) is any source to provide electrical power to the devices attached to the bag. Some examples of electrical power source are: a battery; an ac/dc converter; a dc/dc converter; a photovoltaic cell; a connector to connect external power source to bag devices; an operable combination of any of the above.

Electronic Lock

An electronic lock (10) is an electro-mechanical device. Its locking/unlocking operation is controlled by an electronic signal generated by a user input device. Some examples of user input devices are: a remote control with push buttons; a key pad with push buttons installed on the bag; a computer system capable of generating wireless signals.

Electronic Controller

An electronic controller (12) is an electrical/electronic circuit that controls the functioning of electronic and electro-mechanical devices based on the electrical/electronic inputs received. Some examples of the electronic controller's functions are: lock/unlock the electronic lock (10) by actuating an electro-mechanical device like a solenoid; inflate/deflate the bag walls (8) by actuating the electric pump (3); control the pressure regulator (4) based on the inputs received from the pressure sensors (6); receive inputs from the GPS device (16), process the data and transmit the global position through a transmitter (13); receive inputs from the explosive sensor (19), process the data and transmit the alert signal through the transmitter (13).

GPS Device

A GPS device (16) is a global positioning system device capable of determining the global position of the bag. Some of the examples of a GPS device (16) are: a GPS receiver that receives signals from GPS satellites; a differential global positioning system (DGPS) receiver; a magnetometer that senses the magnetic field of the earth to determine the global position.

Description of Embodiments

FIG. 1 illustrates the first embodiment of the basic transportation bag. The bag comprises a housing (1) with two compartments (22) to store the objects for transportation. The housing has fixed outer walls (7) and flexible inner walls (8). An air inlet/outlet valve (2), an electric pump (3), a pressure regulator (4), an electrical power source (5) and one or more pressure sensors (6) are attached inside the bag to the outer walls (7).

The second embodiment of the bag, as shown in FIG. 2, includes all the devices of first embodiment and further includes an electronic lock (10), indicator lights (11), an electronic controller (12), a transmitter/receiver (13) a remote control (14), an antenna (15), an alpha-numeric display (18), a charging connector (20) and a speaker/audio device (21).

The third embodiment of the bag, also illustrated by FIG. 2, includes all the devices of the first and second embodiments, and a GPS device (16). The GPS device is connected to the electronic controller. The GPS device may also be connected to an antenna in case the device is a GPS receiver.

The forth embodiment of the bag, also illustrated by FIG. 2, includes all the devices of the first, second and third embodiments, and an explosive sensor (19).

A block diagram of the transportation bag system is shown in FIG. 3 which includes all the devices shown in FIG. 2 and the memory (17).

The transportation bag may have more than one compartments to store objects of different types. For example, a traveling bag may have two compartments (as shown in FIG. 1); one to store clothes and other to store fragile items such as wine bottles. The walls of the clothes compartment are filled with lower air pressure to avoid wrinkling of the clothes. But the compartment carrying wine bottles need higher pressure in its walls to keep the bottles in place during transportation and prevent breakage.

Another example of the transportation bag is a camera bag with 3 or 4 compartments. A photographer puts in a camera, lenses, filters and sometimes a water bottle in the bag before going on a photo shooting session. There is always some empty space left between the walls and fragile photographic equipment. The transportation bag fills this empty space by inflating the walls to predefined pressures for each compartment, thus preventing possible damage.

Another example of a carrying bag is a lady's hand bag, which is also a fashion accessory. The designer hand bags are very expensive items. The manufacturers, retail stores and owners of such bags take extreme care to retain the value of the bag. Invariably, the empty bag is filled with paper to make it retain its shape which helps to retain the value of the bag. The air-cushioned bag disclosed herein can inflate the bag to a predetermined inside volume (based on the pressure) to maintain its original shape.

The designer bags are sold at a premium price because they are considered fashion accessories. The manufacturers of the designer bags are always looking for new features to make them "cool" and thus appeal to the customers. Adding fancy features such as automatically inflatable air-cushion, remote control, electronic display and indicator lights etc. would increase the appeal of the bag.

In addition to inflating/deflating valves, the bag may have a pressure-relief valve (not shown in figures) thereby enabling air to escape in case the deflating valve mechanism fails to operate.

In case an internal battery is used as the power source for the bag system, the charging connector (20) can be used to charge external electronic devices. For example, a USB (Universal Serial Bus) connector installed on the bag and connected to the battery can be used to charge a cell phone.

As illustrated in FIG. 3, the second, third and forth embodiments include an electronic controller (12) with memory (17). These components enable the manufacturer to add a number of features to the bag. A unique electronic ID can be stored in the memory (17) which provides additional security for the bag. For example, the bag ID can be associated with the passenger airline ticket while traveling. The unique electronic ID can also be stored in an electro-mechanical device where the user can set a number of switches to "0" or "1" position.

It is widely known to the skilled persons in the industry that an electronic controller, especially a programmable controller with memory, provides flexibility for designing a system. More features can be added to the bag system in the future simply by downloading the firmware to the bag memory. A programmable controller also provides a better control system for operating electro-mechanical devices.

The transmitter/receiver (13) and the antenna (15) allow the bag controller (12) to communicate with the external electronic devices. A remote control (14) can be used to operate an electronic lock (10) and track the bag within short distances such as on the luggage belt at the airport. A near-field wireless communication device connected with a computer system at the airport can also operate the electronic lock (10), and also facilitate checking-in the bag, which is faster and more secure than the bar-coded tag system used at the time of the invention.

The electronic lock (10) may be closed/opened by a key pad installed in a recessed and rugged frame on the bag.

The indicator lights (11) such as red and green LEDs (Light Emitting Diodes), small alpha-numeric electronic displays (18) and a speaker/audio device (21) can provide a number of additional features to the bag system. The lights (11), displays (18) and the speaker (21) must be installed on the bag exterior in recessed and rugged frame area to prevent damage during transportation.

The third embodiment of the bag system includes a GPS (Global Positioning System) device (16) which enables tracking of the bag during transportation around the globe. Since each bag has a unique electronic ID stored in its memory (17), the bag can be traced if it is misplaced, lost or stolen. A complete travel history of the bag can be stored at the facilities of security agencies by tracking the bag and associated travelers carrying the bag over a period of time. This feature can help the security agencies to reduce crime and terrorism. Also, it will reduce the cost of airlines associated with misplaced and lost baggage.

The fourth embodiment of the bag includes an explosive sensor (19). An example of a miniature sensor is a Micro Electro Mechanical Sensor (MEMS) capable of detecting chemicals used in explosives by terrorists. This sensor (19) is installed in the bag and connected to the electronic controller (12). The bag system is designed such that if the sensor (19) is tempered with or becomes defective, the system stores the status of the sensor in the bag memory (17). If a bag containing explosives or defective explosive sensor is taken to an airport, or any other facility equipped with a security system capable of receiving the bag signal, the bag alerts the security authorities by sending an electronic signal through the transmitter (13) and the antenna (15). The combination of the unique electronic ID of the bag and the explosive sensor (19) can enable the security authorities to track the bag any time during transportation if the sensor detects any explosives.

During manufacturing, the manufacturer of the bag assigns a user selectable range of predetermined pressure values to the pressure regulator (4). A different pressure value may be assigned for each compartment of the bag. Depending upon the type of pressure regulator (4) used for the bag, a person having skills in the science can determine the exact mechanism to implement this function.

The manufacturer of the bag also assigns a unique electronic ID to each bag. This ID is stored in the bag system as well as in the computer system of the manufacturer. The unique ID is defined to represent the manufacturer, the type of bag and its characteristics like size, color etc. These characteristics help the airlines and security authorities to easily locate a bag in case it is lost or misplaced. This ID is also used by the security authorities to track the bag in case it is used by terrorists, thieves and the like. Depending upon the type of electronic circuitry designed for the bag, a person having skills in the science can determine the exact mechanism to implement this function.

After the objects are put inside the bag by the traveler and bag cover is closed, the inflating process begins. The traveler can manually start the inflating process by pushing a button on the bag or remote control (14), or the process may start automatically after the bag cover is closed, or by some other mechanism designed by the manufacturer. The pressure sensors (6) continuously monitor the air pressure inside the walls (7,8) of each compartment. When a pre-assigned pressure value is reached, the pressure sensor (6) facilitates actuating a mechanism enabling the pressure regulator (4) to stop the inflating of walls. Depending on the type of pressure regulator (4) used for the bag, a person having skills in the science can design a mechanism to perform this function.

Remote Control Functions

For the second, third and forth embodiments of the bag, a number of functions can be designed for the remote control (14). The remote control (14) may have:

i) a transmitter/receiver to send/receive wired/wireless electronic signals to the bag system ii) a push-button to lock/unlock the electronic lock iii) a push-button to initiate sending an electronic signal to the bag for tracking purposes iv) an alpha numeric display and indicator lights to show sending/receiving signals to/from the bag v) an alpha numeric display and indicator lights to indicate distance of the bag from the remote control and the global position of the bag vi) a speaker or a similar device to give audio feedback/messages to the user vii) a mechanical key to manually open/close the bag viii) all remote control functions may be included in a smart phone, a tablet, a computer or a similar device It is understood that the bag system as described in the above embodiments is not limited to the features and functions described, and therefore should not be construed as limitations on the scope. The scope should be determined by the appended claims and their legal equivalents.

Advantages (a) The air cushioned bag disclosed herein provides the same optimum cushioning irrespective of the empty space and volume of the objects (9) stored in the bag compartment. This advantage comes from the fact that the cushioning is determined based on the pressure instead of volume of the compartment. If the bag compartment is near full, the flexible walls (8) are inflated only by a few inches till the walls touch the stored objects (9) and build pressure to a preset value. On the other hand, if the compartment contains only one small glass bottle, the flexible walls (8) expand by several inches and surround the glass object from all sides till the preset air pressure is reached.

(b) During transportation, if the air pressure increases due to high temperature, or decreases due to lower temperature, the pressure regulator (4) actuates the electric pump (3) to reset the pressure to the pre-defined value.

(c) If one of the walls loses its pressure because of some failure and the inner flexible wall (8) collapses, the objects touching the collapsed wall begin to displace resulting in a lower pressure in the opposite wall of the compartment. The change in pressure is detected by the sensors in the opposite wall, and the pressure regulator (4) actuates the electric pump (3) to inflate the opposite wall to its preset value. This prevents damage to the objects stored in the compartment.

(d) The air cushion of the bag walls (7,8) protects delicate and sensitive objects against vibrations.

(e) The air cushioned bag has less weight compared to bags made with soft cushioned materials.

(f) The air cushioned bag with variable thickness of walls allows more volume to store objects compared to fixed thickness walls disclosed by the prior art.

(g) The variable-thickness of air cushioned walls help retain the shape of designer bags.

(h) Features like automatically inflating walls, remote control (14), electronic display (18), indicator lights (11) etc. increase the fashion-appeal of the bag to the customers.

(i) The GPS device (16) helps tracking the bag in case it is misplaced, lost or stolen.

(j) The explosive sensor (19) helps increase the security and safety of people at airport and other public locations.

Conclusion

The air cushioned bag with electro-mechanical devices described in the above embodiments overcomes the deficiencies of the prior art by providing a solution for safe and secure transportation of objects. The bag provides the same optimum cushioning irrespective of the empty space and volume of the objects inside the bag compartments thereby preventing damage. It helps in tracking the bag during transportation and locating the bag in case it is misplaced, lost or stolen. It also adds to the security of people at public places like airports by detecting bags having explosives inside and alerting the security authorities.

The invention claimed is:

1. A transportation bag system comprising:

a housing having one or more compartments with fixed outer walls and expandable inner walls surrounding one or more objects for transportation, wherein the space between outer walls and inner walls is filled with air;

one or more electrically powered inflating devices for filling the housing walls with air;

one or more valves to allow flow of air in to/out of the housing walls;

one or more pressure sensors for monitoring the air pressure of the bag walls;

one or more pressure regulators to facilitate filling the walls to a predetermined air pressure; and one or more electrical power sources to supply power to the bag system.

2. The system of claim 1 further comprising one or more electronic controllers connected at least to:

the bag power sources to receive electrical power;

the pressure sensors for receiving air pressure inputs;

the pressure regulators to control the flow of air into/out of the container.

3. The system of claim 2 further comprising an electronic lock to lock/unlock the bag.

4. The system of claim 2 further comprising a remote control for the bag system to electronically send user inputs and electronically receive the bag status information for the user.

5. The system of claim 2 further comprising:

a GPS device for determining the global position of the bag in association with one or more electronic controllers;

a unique electronic ID stored in the bag circuitry for identifying the bag;

an antenna; and a transmitter/receiver for receiving the global positioning related data and transmitting the global position information along with the unique ID of the bag.

6. The system of claim 2 further comprising:

an explosive sensor to detect and determine the presence of an explosive inside the bag in association with one or more electronic controllers; and a transmitter to transmit the data related to the presence of the explosive to external security system.

7. The system of claim 2 further comprising:

an electronic lock to lock/unlock the bag;

a GPS device for determining the global position of the bag in association with one or more electronic controllers:

a unique electronic ID stored in the bag circuitry for identifying the bag;

an explosive sensor to detect and determine the presence of an explosive inside the bag in association with one or more electronic controllers;

a transmitter/receiver for communicating with external electronic devices and systems;

one or more antennas;

a remote control to electronically send user inputs and electronically receive the bag status information for the user;

a charging connector connected to the bag battery for charging external electronic devices;

one or more indicator lights to show the bag status;

one or more alpha numeric displays to display the bag status and messages; and one or more audio output devices to inform the user about the status of the bag and related messages.

8. A transportation bag system comprising:

a housing having one or more compartments to store one or more objects for transportation;

a GPS device for determining the global position of the bag in association with an electronic controller;

a unique electronic ID stored in the bag system circuitry for tracking the bag during transportation;

an electronic controller connected to at least the GPS device for receiving and processing the bag GPS data;

an antenna;

a transmitter/receiver to enable the GPS device communicate with an external GPS tracking system; and an electrical power source to supply power to the bag system.

9. The system of claim 8 further comprising:

a housing having one or more compartments with fixed outer walls and expandable inner walls surrounding one or more objects for transportation, wherein the space between outer walls and inner walls is filled with air;

one or more electrically powered inflating devices for filling the housing walls with air;

one or more valves to allow flow of air in to/out of the housing walls;

one or more pressure regulators to facilitate filling the walls to a predetermined air pressure; and one or more pressure sensors for monitoring the air pressure of the bag walls.

10. The system of claim 8 further comprising one or more electronic locks to lock/unlock the bag.

11. The system of claim 8 further comprising a remote control for the bag system to electronically send user inputs and electronically receive the bag status information for the user.

12. The system of claim 8 further comprising:

an explosive sensor to detect and determine the presence of an explosive inside the bag in association with one or more electronic controllers; and a transmitter to transmit the data related to the presence of the explosive to external security system.

13. The system of claim 9 further comprising one or more electronic locks to lock/unlock the bag.

14. The system of claim 13 further comprising a remote control for the bag system to electronically receive user inputs and electronically send the status information for the user.

15. A transportation bag system comprising:

a housing having one or more compartments to store one or more objects for transportation;

an explosive sensor for detecting explosives stored inside the bag;

an electronic controller connected to at least the explosive sensor for processing the sensor data;

an antenna;

a transmitter for communicating with an external security system; and an electrical power source to supply power to the bag system.

16. The system of claim 15 further comprising:

a housing having one or more compartments with fixed outer walls and expandable inner walls surrounding one or more objects for transportation, wherein the space between outer walls and inner walls is filled with air;

one or more electrically powered inflating devices for filling the housing walls with air;

one or more valves to allow flow of air in to/out of the housing walls;

one or more pressure regulators to facilitate filling the walls to a predetermined air pressure; and a pressure sensor for monitoring the air pressure of the bag walls.

17. The system of claim 15 further comprising one or more electronic locks to lock/unlock the bag.

18. The system of claim 15 further comprising a remote control for the bag system to electronically send user inputs and electronically receive the bag status information for the user.

19. The system of claim 16 further comprising one or more electronic locks to lock/unlock the bag.

20. The system of claim 19 further comprising a remote control for the bag system to electronically send user inputs and electronically receive the bag status information for the user.

* * * * *